US011717073B2

(12) United States Patent
Ciniello et al.

(10) Patent No.: US 11,717,073 B2
(45) Date of Patent: Aug. 8, 2023

(54) SYSTEM FOR INTERFACING WITH AN OPERATOR'S BODY FOR A FUNCTION UNIT

(71) Applicant: Comau S.p.A., Grugliasco (IT)

(72) Inventors: Francesco Ciniello, Grugliasco (IT); Andrea Francesco Sola, Grugliasco (IT); Mauro Morbidelli, Grugliasco (IT)

(73) Assignee: Comau S.p.A., Grugliasco (IT)

( * ) Notice: Subject to any disclaimer, the term of this patent is extended or adjusted under 35 U.S.C. 154(b) by 219 days.

(21) Appl. No.: 17/138,137

(22) Filed: Dec. 30, 2020

(65) Prior Publication Data

US 2021/0219705 A1 Jul. 22, 2021

(30) Foreign Application Priority Data

Jan. 16, 2020 (IT) ..... 102020000000751

(51) Int. Cl.
*A45F 3/14* (2006.01)

(52) U.S. Cl.
CPC ..... *A45F 3/14* (2013.01); *A45F 2003/144* (2013.01); *A45F 2003/146* (2013.01)

(58) Field of Classification Search
CPC ..... A45F 3/14; A45F 2003/146; A45F 2003/144; A45F 5/00; A45F 3/12; A45F 3/08
USPC ..... 224/265
See application file for complete search history.

(56) References Cited

U.S. PATENT DOCUMENTS

| | | | | |
|---|---|---|---|---|
| 5,904,282 | A * | 5/1999 | Gleason | A45F 3/08 224/636 |
| 10,342,319 | B1 * | 7/2019 | Alabdulkarim | A45F 3/08 |
| 2016/0000212 | A1 * | 1/2016 | Lee | A45F 3/08 224/265 |

FOREIGN PATENT DOCUMENTS

| | | | |
|---|---|---|---|
| CN | 109333505 | A | 2/2019 |
| DE | 102018123017 | B3 | 12/2019 |
| KR | 20110101656 | A * | 9/2011 |
| KR | 20110101656 | A | 9/2011 |
| WO | 2019016629 | A1 | 1/2019 |

* cited by examiner

*Primary Examiner* — Nathan J Newhouse
*Assistant Examiner* — Lester L Vanterpool
(74) *Attorney, Agent, or Firm* — Young Basile Hanlon & MacFarlane, P.C.

(57) ABSTRACT

A system for interfacing with an operator's body for distributing forces to the operator's body received by the system from a function unit. The system includes a frame and a plurality of contact units connected to the frame which are positioned and communicate with the operator's torso to distribute the received forces. The plurality of contact units each include a first and second support having an elastic body positioned therebetween which allows relative movement between the first and second supports.

20 Claims, 6 Drawing Sheets

K
K1
4I
4II
4III(1)
2
I
δ

SYSTEM FOR INTERFACING WITH AN OPERATOR'S BODY FOR A FUNCTION UNIT

CROSS-REFERENCE TO RELATED APPLICATIONS

This application claims priority benefit to Italian Patent Application No. 102020000000751 filed Jan. 16, 2020, the entire contents of which is incorporated herein by reference.

TECHNICAL FIELD

The present invention relates to a system for interfacing with an operator's body for a function unit.

BACKGROUND

These systems are intended to be coupled with a generic function unit, for example, a piece of equipment, a transport unit, etc., and are worn by the operator to perform the function of discharging the forces generated by the unit on the body of the operator, usually relieving the arms of the operator of part of the efforts.

Interface systems of this type are becoming more and more widespread in the various work areas, for example, in industry, construction sites, the agricultural sector, etc., following the trend, which has been in place for some time now, to provide increasingly more stringent requirements for the working conditions of workers.

However, known interface systems have various drawbacks, including the fact that—on average—they are uncomfortable; they cause discomfort or even pain following prolonged use; they make the operator sweat; and they are unsuitable for use by several people, to name the main drawbacks that are of interest for this discussion.

SUMMARY

In this context, the present invention aims to provide an improved interface system with respect to known systems, in particular, one that overcomes one or more of the aforesaid drawbacks.

This object is achieved through an interface system having the characteristics referred to in claim 1.

The claims form an integral part of the technical disclosure provided here in relation to the invention.

BRIEF DESCRIPTION OF THE DRAWINGS

Further characteristics and advantages of the invention will become evident from the description that follows with reference to the attached drawings, provided purely by way of non-limiting example, wherein.

DETAILED DESCRIPTION

In the following description, various specific details are illustrated aimed at a thorough understanding of the embodiments. The embodiments may be implemented without one or more of the specific details, or with other methods, components, materials, etc. In other cases, known structures, materials or operations are not shown or described in detail to avoid obscuring various aspects of the embodiments.

The references used here are only for convenience and do not, therefore, define the field of protection or the scope of the embodiments.

The solution described here relates to a system for interfacing with an operator's body for a function unit. This term here refers to any unit arranged for carrying out a given function or operation. It can, for example, be a tool, a piece of equipment, an apparatus, a device, etc. The function or operation may be of any type and for any area of activity, for example, industry, construction site, agricultural sector, trade, etc.

The interface system in question is, in particular, intended for those applications wherein the function unit is arranged to be carried by an operator, and performs the function of discharging the forces generated by the unit onto the operator's body.

Figure 1B:
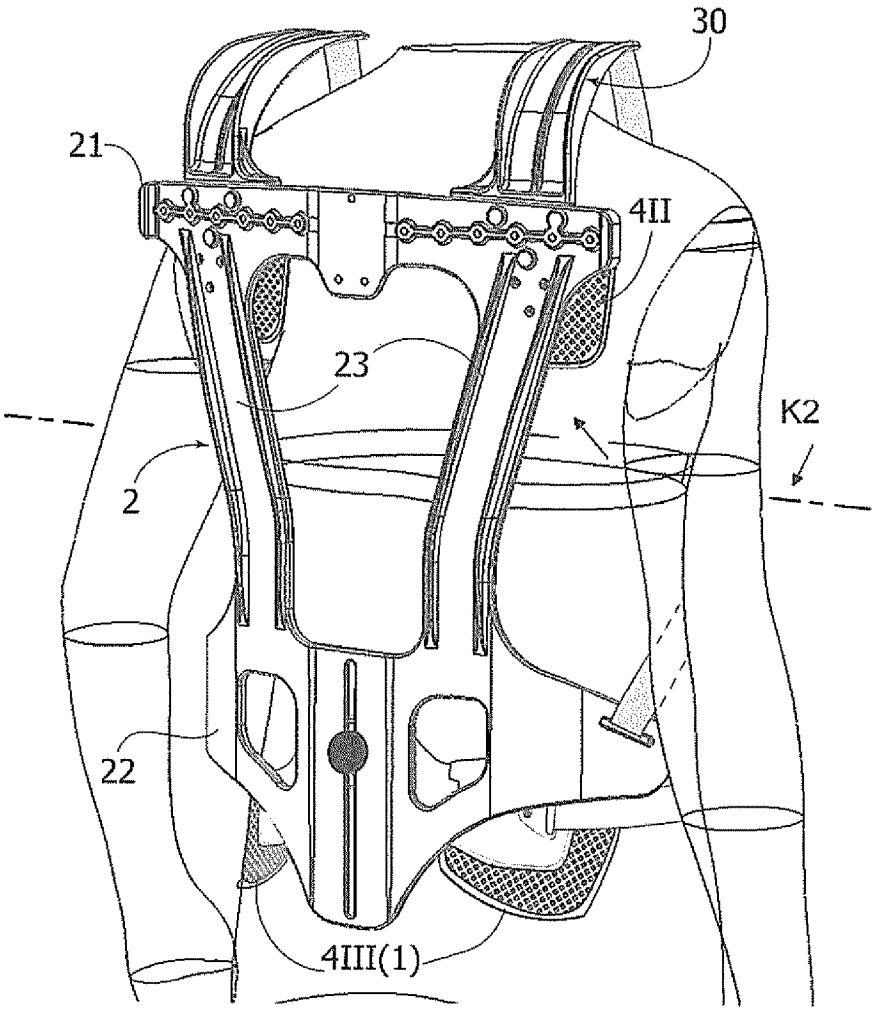
FIGS. 1A and 1B represent a preferred embodiment of the interface system described here, according to a front view and a rear view, respectively.
Figure 1A:
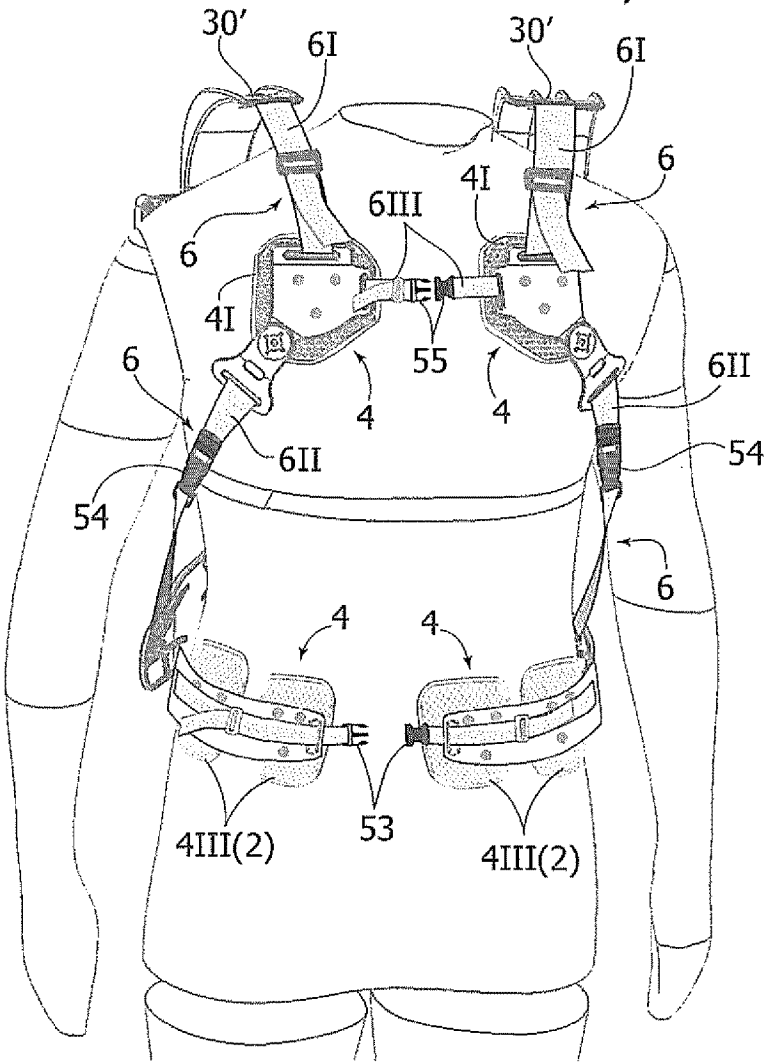

In general, the interface system described here, indicated in the figures with the reference number 10, comprises:

- a frame 2 intended to be positioned on the rear side of the operator's torso, and defining a main extension direction K which, in a worn condition of the system, is oriented parallelly to the longitudinal axis of the operator K1;
- a plurality of contact units 4, which are connected to the frame 2 and are intended to be brought into contact with the operator's torso and hips, wherein this plurality of contact units 4 comprises:

- a first series of contact units 4I (FIG. 1A) configured to position themselves on the front side of the operator's thoracic region;
- a second series of contact units 4II (FIG. 1B) configured to position themselves on the rear side of the operator's thoracic region; and
- a third series of contact units 4III (FIGS. 1A and 1B) configured to position themselves on the operator's hips;

wherein each contact unit 4 comprises a first and a second support 41, 42, and at least one elastic body 43, 43A, 43B, which is interposed between the first and the second support, and which is deformable so as to allow position and/or orientation variations between the first support 41 and the second support 42; the first support 41 being intended to be brought into contact with the operator's body in the worn condition of the interface system;

- a plurality of flexible elements 6 for connecting the contact units 4I to the frame 2.

The frame 2 constitutes the component of the system to which the function unit is connected, and to which the forces generated by the function unit are transmitted, while the contact units 4 constitute the components of the system through which the forces transmitted from the function unit to the frame 2 are discharged onto the operator's body.

These contact units 4 are designed to be positioned on the front and rear sides of the operator's rib cage, to mainly discharge the angular moments transmitted to the frame 2; and on the hips, to mainly discharge the vertical forces transmitted to the frame 2.

Overall, the forces generated by the function unit are transmitted to the operator's body entirely, or almost entirely or substantially, by the contact units 4.

The regions of the operator's body not in contact with the units 4 are, therefore, not involved (at least not directly) in supporting the loads and forces generated by the function unit.

As indicated above, each contact unit is formed by at least two mutually movable and elastically connected supports, so that it is able, on one hand, to adapt to the conformation of the body of different operators, and on the other hand, to follow the movements of the operator's body and to elastically contrast the forces transmitted by the frame 2.

Thanks to the characteristics indicated above, the interface system 10 is generally comfortable to wear, and capable of relieving the neck, the trapezius muscle regions, the shoulders, and the abdominal region of the operator from loads, which are extremely sensitive parts to prolonged exertion.

With reference now to preferred embodiments of the system described here, the frame 2 comprises an upper portion 21, intended to be positioned at the scapular region of the operator, and a lower portion 22, intended to be positioned at the lumbar or lumbosacral region of the operator.

In preferred embodiments, as in the one illustrated, the frame 2 also comprises two side portions 23, which extend parallelly to the main direction K and connect the upper portion 21 and the lower portion 22 to each other.

The two side portions 23 are spaced apart along a direction K2 transverse to the direction K, so as to arrange themselves on opposite sides of the operator's vertebral column, thus leaving this region of the body free.

The frame 2 has a rigid structure and can be made of metal, for example, aluminum, or of a rigid plastic material, for example, PLA (polylactic acid), optionally loaded with carbon, or even made of wood.

Figure 3B:
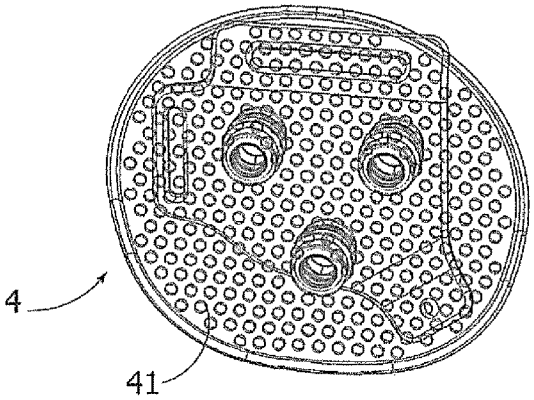
FIGS. 3A, 3B and 3C represent a component of the interface system of FIG. 1 according to three-quarter views, respectively, from above, from below and from the side.
Figure 3A:
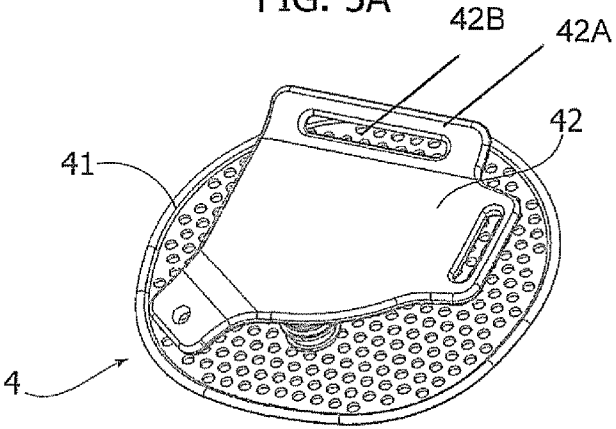

With reference to FIGS. 3A-3B, the two supports 41, 42 of the contact units 4 may be made of plastic material, for example nylon, PET or PLA.

In preferred embodiments, as well as in the one illustrated, the support 41, which is intended to come into contact with the body of the operator, is formed of a semi-rigid and perforated plate over a prevalent area of its extension. The holes obtained thereon have the function of accentuating the elastic behavior of the plate, and, on the other hand, of allowing the parts of the operator's body with which the plate comes into contact to breathe.

The support 42 of the contact units 4 is also formed of a plate, of which the structure may be rigid or semi-rigid. One or more attachment points 42A are arranged on this plate 42 for connecting the unit 4 to the frame 2 or to the flexible elements 6.

The attachment points 42A in question can be of various types. For example, as illustrated in FIGS. 3A-3C, for connecting to a flexible element 6, the plate 42 may have one or more slots 42B for fastening these elements.

For connecting to the frame 2, the plate 42 may, instead, have one or more holes (not illustrated) for fixing to the frame 2 by means of screws or other fastening members of an equivalent type.

Figure 3C:
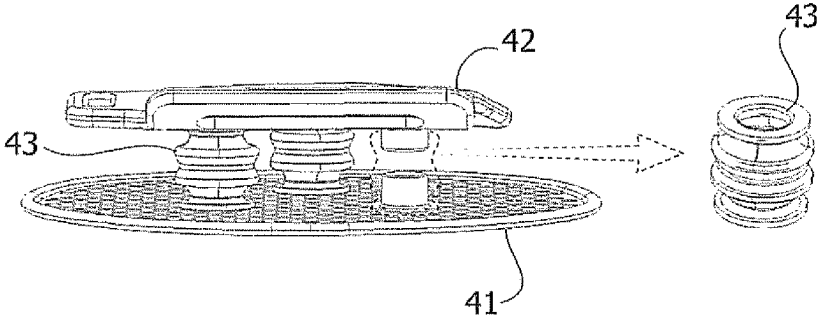

In preferred embodiments, as well as in the one illustrated in FIG. 3C, the elastic bodies 43 consist of substantially tubular bodies, preferably made of rubber, which are arranged with their axis oriented transversely to the supports 41 and 42. These bodies are designed to be squeezed due to a change in position and/or orientation between the two supports 41 and 42, and operate on these with an elastic action to return to their extended condition. The number and distribution of these tubular bodies between the two supports 41 and 42 are chosen so that the loads transmitted to the supports 42 are discharged over an extended area of the supports 41 and, consequently, over an area of equal extension of the body of the operator.

In some embodiments (not shown), the bodies 43 may also contain a gas under pressure to accentuate their elastic behavior.

Figure 4A:
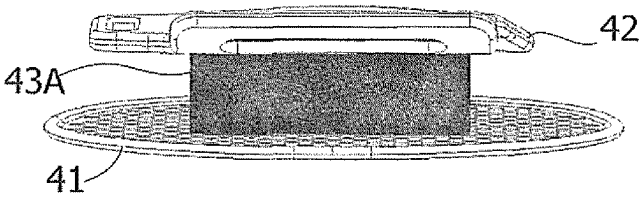
FIGS. 4A and 4B represent variants of the component of FIGS. 3A, 3B and 3C.
Figure 4B:
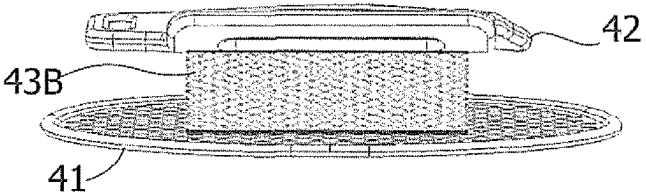

In alternative embodiments, the contact units 4 may, on the other hand, comprise one or more elastic bodies 43A, 43B consisting of closed cell foams or flexible reticular structures. In this regard, FIGS. 4A and 4B illustrate two examples wherein the contact unit 4 comprises a single elastic body, in the shape of a parallelepiped, which—in the example of FIG. 4A—the elastic body 43A consists of a closed cell foam, and—in the example of FIG. 4B—the elastic body 43B consists of a flexible reticular structure. The materials used can be polymeric materials, for example, rubbers, polyurethane, polyamide, etc.

Figure 5:
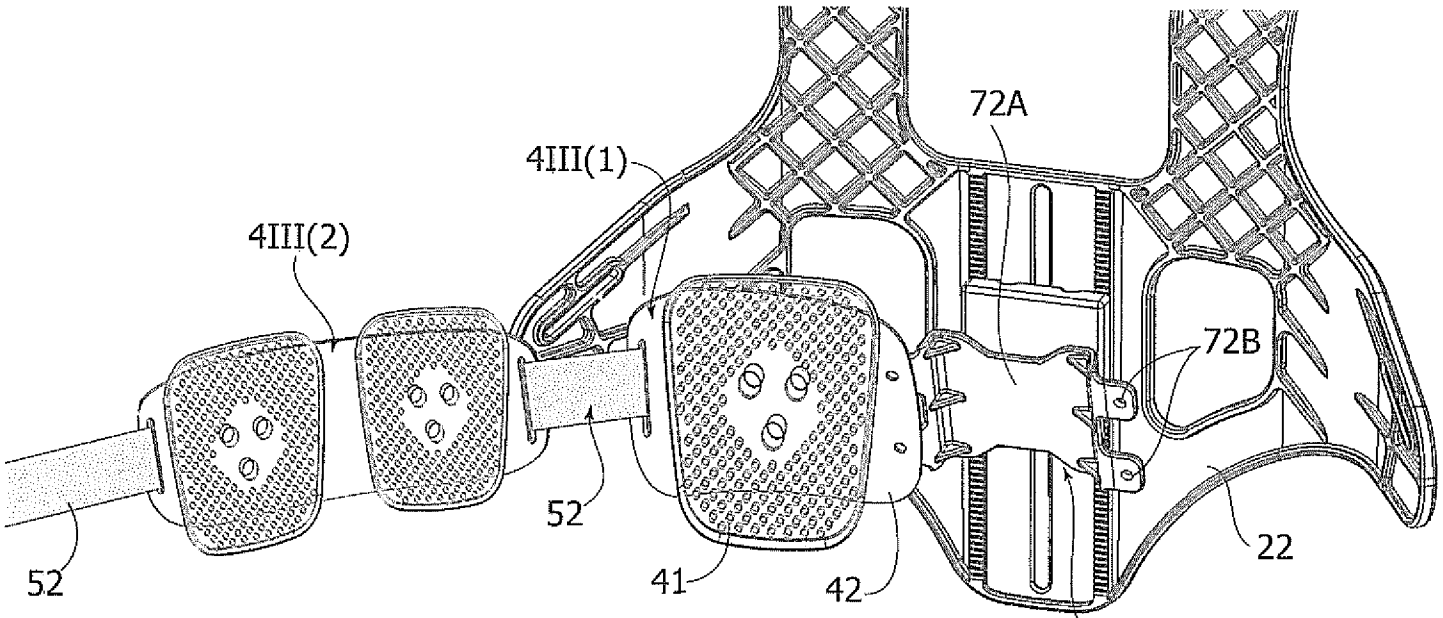
FIG. 5 represents a detail of the interface system of FIG. 1 partially disassembled.

With reference now to FIG. 5, in preferred embodiments, as well as in the one illustrated, the contact units 4III constitute a belt configured for wrapping around the operator's hips, having a chain-type structure. In particular, the different units 4III are connected to each other through the respective plates 42 so as to be able to rotate and vary their orientation with respect to the adjacent units. In preferred embodiments, as well as in the one illustrated, this connection can be made through flexible elements 52 such as, for example, tapes or belts.

Alternatively, each contact unit 4III can be connected to the adjacent unit by means of a hinge (not shown), which rotatably connects the relative plates 42 of the two contact units.

In preferred embodiments, as well as in the one illustrated, the contact units 4III differ from each other according to the part of the hips on which they are intended to come into contact.

The third series of contact units 4III comprises, in particular, two contact units 4III(1), which are intended to be positioned on the rear side of the hips, in symmetrical positions with respect to the vertebral column, and preferably at the level of the iliac-lumbar region.

The third series in question also comprises two contact units 4III(2) which are, instead, intended to be positioned on the front side of the hips, preferably in symmetrical positions with respect to the vertebral column, and at the level of the lower abdomen.

The contact units 4III(2) are distinguished from the contact units 4III(1) in that they each provide a single second support 42, which is common to two first supports 41; each of the two first supports 41 is connected to the second support 42 by means of a respective elastic body 43, 43A, or 43B. The second support 42 has a longitudinal extension intended to orient itself along the circumference of the operator's hips, and is equipped with a semi-rigid structure so that it can bend, adapting to the shape of the operator's body.

Preferably, on each side of the vertebral column, the corresponding contact units 4III(1) and 4III(2) are arranged over the iliac crest of the pelvis.

Figure 5A:
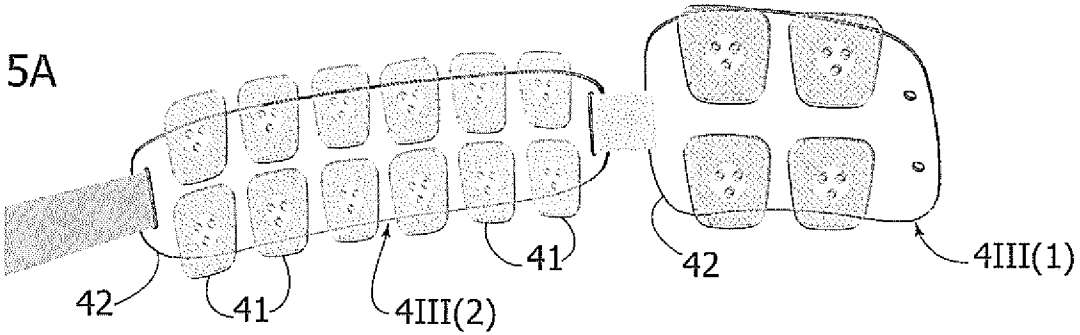
FIG. 5A represents a variant of the system of FIG. 1.

As illustrated in the variant of FIG. 5A, the size and number of supports 41 carried by the single second support 42, may vary according to the requirements of the specific applications, regarding both the contact units 4III(1) and the contact units 4III(2).

In alternative embodiments (not shown), the contact units 4III, instead, all have the same structure in which each second support 42 carries a single first support 41. In this case, preferably the individual contact units have small dimensions to engage a restricted area of the operator's body. On the other hand, the series constituted by the contact units has a significantly higher number than the embodiment illustrated, so that all the units together, in a discretized way, still cover a prevalent part of the circumference of the operator's hips.

In general, the series of contact units 4III is designed to adapt to the shape of the hips of different operators, always remaining wrapped around and adherent thereto, and to distribute the loads along an extended and prevalent part of the circumference of the hips.

Preferably, the series of flexible elements 52 that connect the supports 42 of the different contact units 4III(1) and 4III(2), also includes releasable connecting members 53 (for example, clip fasteners of the type used for backpacks) to close the system 10 on the operator's hips.

Returning to FIGS. 1A and 1B, in preferred embodiments, as well as in the one illustrated, the first series of contact units 4I comprises only two contact units, which are arranged to be positioned on the front side of the operator's rib cage, preferably in symmetrical positions with respect to the vertebral column.

In preferred embodiments, as well as in the one illustrated, the second series of contact units 4II comprises only two contact units, which are fixed to the frame 2 and are arranged to be positioned on the scapular regions of the operator, preferably in symmetrical positions with respect to the vertebral column.

In alternative embodiments (not shown), the contact units 4I and 4II may, instead, be single or consisting of a number greater than two, based on the requirements of specific applications.

It should be noted that the worn system 10 is designed to leave the region along the vertebral column free on the rear side of the operator's torso, since, as seen, the contact units 4II and 4III(1) and the side portions 23 of frame 2 are all positioned, symmetrically, on opposite sides of this region.

The flexible elements 6 connect the contact units 4I to the frame 2 and, in general, are arranged to create the fastening of the system 10—as a whole—to the body of the operator.

In preferred embodiments, as well as in the one illustrated, the series of flexible elements 6 comprises elements 6I (first flexible elements), which connect the two contact units 4I to the upper portion 21 of the frame 2, and two elements 6II (second flexible elements), which connect the same contact units to the lower portion 22 of the frame. Overall, the elements 6I and 6II constitute shoulder straps.

The elements 6I and 6II may be connected to the contact units 4I and to the frame 2, with the possibility of varying their length between these units, and the upper and lower portions 21, 22 of the frame 2, in order to provide an adjustment of the system, to adapt it to the operator's build. Optionally, the elements 6II may include releasable connecting members 54 to determine their opening in order to facilitate putting on or taking off the system.

Two additional elements 6III (third flexible elements) are each connected to a respective contact unit 4I, and are arranged with releasable connecting members 55 (for example, clip fasteners of the type used for backpacks, hooks, VELCRO, etc.) to connect the two elements 6III and, in this way, to close the system 10 on the operator's torso.

The flexible elements 6I, 6II and 6III may be constituted by belts or tapes, made, for example, of fabric or non-woven fabric.

In preferred embodiments, as well as in the one illustrated, the system 10 comprises two spacer elements 30, which are attached to the upper portion 21 of the frame 2 and extend beyond it, in an opposite direction with respect to the side portions 23, in such a way that, in the worn condition of the system, these elements rise above the regions of the trapezius and clavicular muscles, and their ends 30' are positioned at a distance from these regions.

The flexible elements 6I are connected to the ends 30' of the elements 30, and not directly to the upper portion 21 of the frame 2.

In this way, they do not press on the trapezius muscles or on the collarbones, making the system particularly comfortable to wear.

The spacer elements 30 may be made of metal or of plastic material, like the frame 2.

In alternative embodiments, the spacer elements 30 may be formed of appendages of the same frame 2.

The series of contact units 4III is connected to the lower portion 22 of the frame 2 so that the vertical forces transmitted by the frame are discharged onto the hips of the operator.

Preferably, this connection is made between the lower portion 22 and the two contact units 4III(1), which are arranged to be positioned on the iliac-lumbar regions.

Figure 2:
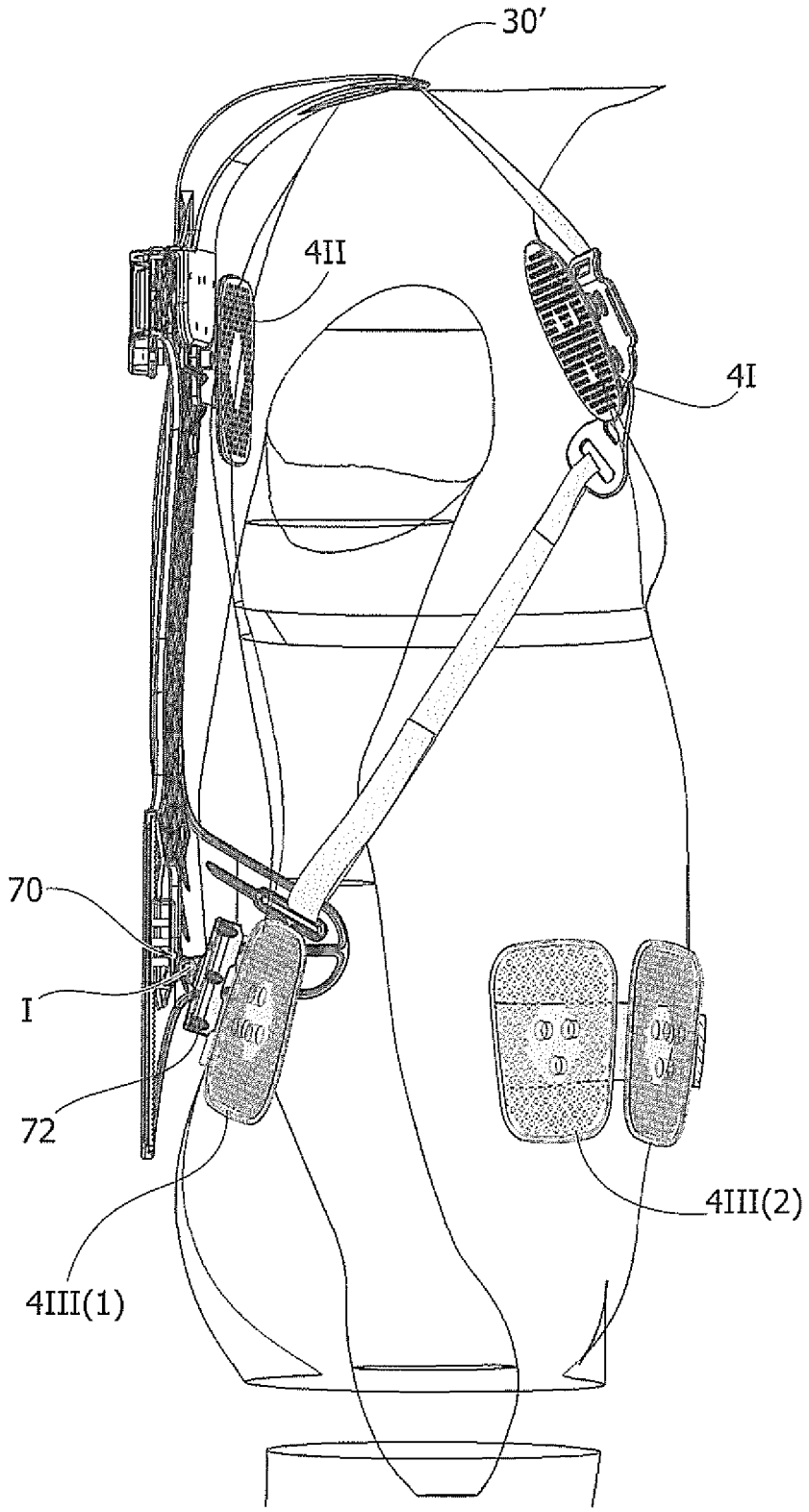
FIG. 2 represents a side view of the interface system of FIG. 1.

In preferred embodiments, as well as in the one illustrated in FIG. 2, the two units 4III(1) are connected to the lower portion 22 through a hinge 70 that defines a rotation axis I intended, in the worn condition of the system 10, to be positioned horizontally, in a sagittal plane of the operator, to allow the contact units to vary their orientation according to the orientation of the operator's hips. In this regard, FIGS. 7A-7D schematically illustrate how the two contact units 4III(1) are positioned differently around the rotation axis I, depending on the different posture of the operator's pelvis. In particular, this Figure shows the variations of the angle δ which is defined between a direction parallel to the longitudinal axis of the operator K1 and the direction wherein a bracket 72 carrying the two contact units 4III(1) is arranged.

In preferred embodiments, as well as in the one illustrated in FIG. 5, the two units 4III(1) are carried by the bracket 72 having a central portion 72A, connected to the lower portion 22 of the frame 2 through the hinge 70, from which side tabs 72B protrude (on opposite sides with respect to the direction K) to which the second supports 42 of the contact units 4III(1) are fixed, for example by means of screws.

Figure 6:
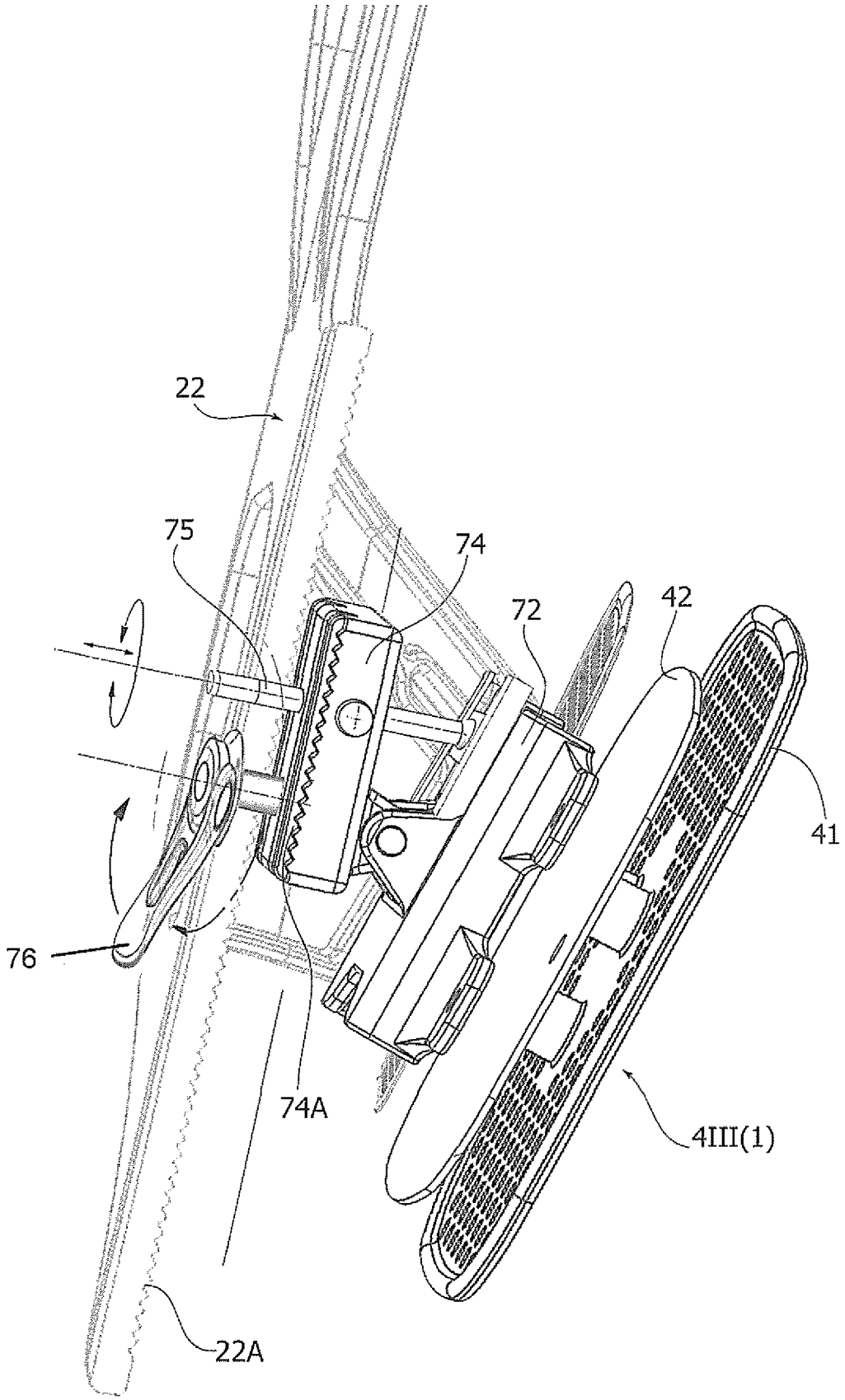
FIG. 6 represents a detail of the system of FIG. 1.
Figures 7A, 7B, 7C, 7D:
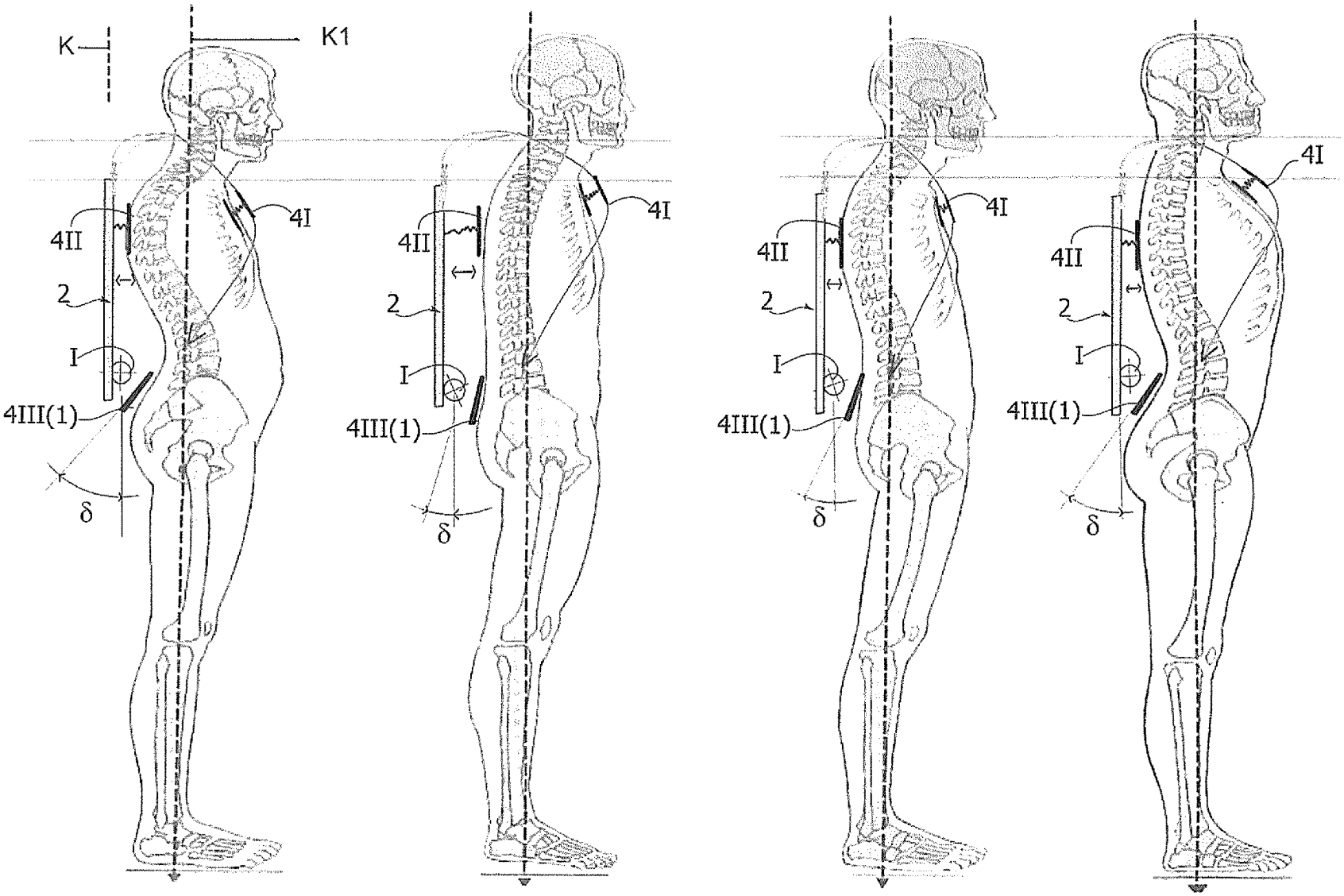
FIGS. 7A-7D illustrate a series of examples wherein the system described here is worn by operators with different postures and builds.

In preferred embodiments best seen in FIGS. 2 and 6, the hinge 70 is equipped with a system designed to block the movement of the hinge and thus fix the two contact units 4III(1) in the orientation selected by the operator, after he has worn the interface system and made adjustments to suit his/her body size. Preferably, this system comprises an adjustment member, for example, a screw 75, as in the illustrated embodiment, to facilitate adjustment of the position of the hinge by the operator.

In alternative embodiments, the hinge 70 is, instead, kept mobile even when the operator is wearing the system and is working, so that the two units 4III(1) can follow the movements of his hips.

In preferred embodiments, as well as in the one illustrated, the two contact units 4III(1) are also adjustable in a position along the direction K of the frame 2, to provide the possibility of adjusting the distance between the series of contact units 4III and the series of contact units 4II, as a function of the height of the operator.

In particular, in preferred embodiments, as well as in the one illustrated, the bracket 72 is—in turn—carried by a support 74, which can be fixed to the lower portion 22 in different positions along the direction K, through a position adjustment system. This system may be of various types and, in particular, can be arranged for continuous or discrete position adjustment. For example, this system may provide two toothed portions 74A, 22A, which can be coupled in different relative positions along the direction K, and a clamping lever 76, or any other locking member of equivalent type, by means of which the two portions may be fixed in the relative position selected by the operator.

In view of the above, it is now clear how the interface system described here has a simple and essential structure, wherein, on the one hand, the frame 2, present only on the rear side of the operator's rib cage, provides the necessary rigidity to resist the stresses transmitted by the function unit to the system, and, on the other hand, the contact units 4 provide the points—the only ones—through which the system unloads the forces on the operator's body.

As seen, the units 4 in question consist of two supports, elastically connected together, and are, instead, completely free of padding materials (for example, sponges, rubber, etc.), which are, conversely, very widespread in the prior art.

Beyond the advantages already discussed above, this structure of the contact units 4, totally devoid of absorbent materials, offers a series of further advantages, such as not absorbing the operator's sweat, being easily washable, and that the system is suitable for outdoor use.

The contact units thus made are, moreover, more durable with respect to padded elements that tend to deform permanently, over time. Moreover, where required, the supports 4I of the contact units 4 can—in any case—be covered with caps made of soft material, for example, of the disposable type.

Overall, the interface system described here is also extremely light.

As mentioned above, the interface system 10 may be used in combination with any function unit.

A specific application whereby the system described here may be particularly advantageous concerns the field of systems for assisting exertion of efforts (also called "exoskeletons"). In this regard, the interface system described here may be advantageously used for a system for assisting exertion of efforts, of the type described in the application PCT WO2019016629.

Of course, without prejudice to the principle of the invention, the details of construction and the embodiments may vary, even significantly, with respect to those illustrated here, purely by way of non-limiting example, without departing from the scope of the invention as defined by the attached claims.

What is claimed is:

1. A system for interfacing with an operator's body for a function unit, comprising:

a frame positioned on a rear side of an operator's torso, and defining a main extension direction which, in a worn condition by the operator of said system, is oriented parallelly to a longitudinal axis of the operator;

a plurality of contact units, which are connected to said frame and, in the worn condition of said system, are operable to be brought into contact with the operator's torso and an operator's hips, wherein said plurality of contact units comprising:

a first contact unit configured to be positioned on a front side of an operator's thoracic region;

a second contact unit configured to be positioned on a rear side of the operator's thoracic region;

a third contact unit configured to be positioned on the operator's hips;

wherein each of the plurality of contact units comprise a first and a second support, and at least one elastic body, which is interposed between said first and second support, and which is deformable so as to allow at least one of position or orientation variations between said first and second supports, said first support being operable to be brought into contact with the operator's body in said worn condition of the interface system; and a plurality of flexible elements operable to connect to said frame and said first contact unit.

2. The system according to claim 1, having such an arrangement of said flexible elements and of said plurality of contact units that, in said worn condition, forces generated by said function unit are transmitted to the operator's body exclusively by and through said plurality of contact units to the respective thoracic region and the operator's hips.

3. The system according to claim 1, wherein said frame further comprises an upper portion operable to be positioned at a height of an operator's scapula region, and a lower portion operable to be positioned at a height of the operator's lumbar or lumbosacral region, wherein said second contact unit is mounted on said upper portion of said frame, and wherein said third contact unit is mounted on said lower portion of said frame.

4. The system according to claim 3, wherein said third contact unit is adjustable in position along said main extension direction to selectively set a distance between said third contact unit and said second contact unit.

5. The system according to claim 3, wherein said third contact unit is connected to said frame lower portion in a rotatable manner about a horizontal rotation axis, the third contact unit positioned in a sagittal plane of the operator and at the height of the operator's lumbar or lumbosacral region.

6. The system according to claim 3, wherein the third contact unit comprises a third series of contact units, wherein said third series of contact units comprise a belt comprising at least one of the plurality of flexible elements operable to wrap around the operator's hips in said worn condition of the system.

7. The system according to claim 6, wherein said third series of contact units further comprises two rear contact units, which are symmetrically positioned with respect to the main extension direction of said frame and which are configured to be positioned on lumboiliac regions of the operator's body, while leaving the lumbosacral region free from contact by the third series of contact units.

8. The system according to claim 7, wherein said third series of contact units further comprises two front contact units connected to the frame by the belt, the two front contact units of the third series of contact units are symmetrically positioned with respect to the main extension direction of said frame and positioned laterally distant from each other and at opposite sides of an operator's vertebral column on the operator's hips, and which are configured to be positioned at a height of a lower region of an operator's abdomen.

9. The system according to claim 3, wherein said frame further comprises two side portions, which extend parallelly to said main extension direction and join together the upper portion and the lower portion, wherein said two side portions are set at a distance from one another along a direction that is transversal to said main extension direction, so as to position themselves, in said worn condition of said system, at opposite sides of an operator's vertebral column, while leaving the operator's vertebral column of the body free from contact by said plurality of contact units.

10. A system according to claim 3, wherein said plurality of flexible elements comprises one or more first flexible elements operable to connect said first contact unit to said upper portion of said frame, and one or more second flexible elements that connect said first contact unit to said lower portion of said frame.

11. The system according to claim 3, wherein said system further comprises one or more spacer elements connected to said frame and at least one of the plurality of flexible element, the one or more spacer elements extend at least partially parallel to said main extension direction, so that, in the worn condition of said system, said connected at least one flexible element rises above an operator's trapezoidal muscles and clavicular regions, and keep themselves at a distance therefrom whereby forces generated by said function unit are not directly transmitted to the operator's trapezoidal muscles and the clavicular regions.

12. The system according to claim 1, wherein; in each of the plurality of contact units, said first and second supports are made of plastic, wherein said first support comprises a semi-rigid plate, wherein the plate defines through perforations over a substantial area of its extension, and wherein said second support comprises a rigid or semi-rigid plate, said plate having one or more connecting points for connecting the contact unit to said frame or to one of said plurality of flexible elements.

13. The system according to claim 1, wherein said first contact unit comprises two first contact units, which are configured to position themselves on a front side of a ribcage of the operator at symmetrical positions laterally distant from one another with respect to an operator's vertebral column, the two first contact units are connected to the frame by at least one of the plurality of flexible elements.

14. The system according to claim 13, wherein said second contact unit comprises two second contact units, which are configured to position themselves on an operator's scapula regions at symmetrical positions with respect to the operator's vertebral column.

15. The system according to claim 13, comprising a releaseable connecting member connected to the at least one flexible element, the releaseable connecting member operable to selectively connect the two first contact units to one another and releasably lock said system over the operator's torso.

16. The system according to claim 1, wherein said frame is made of aluminum or of a rigid plastic carbon-loaded material.

17. The system according to claim 1, wherein said plurality of flexible elements comprise at least one of belts or bands.

18. The system of claim 1 wherein:

the first contact unit comprises a first series of contact units;

the second contact unit comprises a second series of contact units; and the third contact unit comprises a third series of contact units.

19. The system of claim 1 wherein the at least one elastic body comprises a plurality of elastic bodies having a tubular configuration.

20. A system for interfacing with an operator's body when in a worn condition is operable to distribute loads transferred to the operator's body exclusively to an operator's thoracic region and an operator's hips, the system comprising:

a frame positioned on a rear side of an operator's torso and defining a main extension direction, a portion of the main extension direction oriented parallel to a longitudinal axis of the operator;

a plurality of contact units comprising:

two first contact units positioned on a front side of the operator's thoracic region and in contact with the front side of the operator's thoracic region in the worn condition, the two first contact units positioned laterally distant from each other and at opposite sides of an operator's vertebral column, the two first contact units are connected to the frame by a first flexible element;

two second contact units positioned on a rear side of the operator's thoracic region and in contact with the rear side of the operator's thoracic region in the worn condition, the two second contact units positioned laterally distant from each other and at opposite sides of the operator's vertebral column; and a series of third contact units comprising:

two rear third contact units positioned on a rear side of the operator's hips and in contact with the rear side of the operator's hips in the worn condition, the two rear contact units connected to the frame and positioned laterally distant from each other at opposite sides of the operator's vertical column;

two front third contact units positioned on a front side of the operator's hips and in contact with the front side of the operator's hips in the worn condition, the two front third contact units are connected to the frame by a second flexible element, the two front third contact units are positioned laterally distant from each other at opposite sides of the operator's vertical column, each of the first two contact units, the two second contact units, and the series of third contact units comprise a first support, a second support, and an elastic body, the elastic body is connected to and positioned between the first support and the second support and is deformable so as to allow at least one of position or orientation variations between the first support and the second support; and two spacer elements connected to the frame and positioned distant from an operator's shoulder region in the worn condition, the two spacer elements are configured to not transfer the loads directly to the operator's shoulders, the two first contact units connected to respective of the two spacer elements by the first flexible element.

* * * * *